US005106814A

United States Patent [19]

Hiraishi et al.

[11] Patent Number: 5,106,814

[45] Date of Patent: Apr. 21, 1992

[54] HEAT-SENSITIVE RECORDING MATERIAL

[75] Inventors: Shigetoshi Hiraishi; Akinori Okada, both of Tokyo; Mikiya Sekine, Warabi, all of Japan

[73] Assignee: Mitsubishi Paper Mills Limited, Tokyo, Japan

[21] Appl. No.: 635,235

[22] Filed: Dec. 28, 1990

[30] Foreign Application Priority Data

Dec. 28, 1989 [JP] Japan ..... 1-340349

[51] Int. Cl.[5] ..... B41M 5/30

[52] U.S. Cl. ..... 503/208; 503/209; 503/217; 503/225

[58] Field of Search ..... 503/208, 209, 217, 225; 427/150–152

[56] References Cited

U.S. PATENT DOCUMENTS 4,521,793 6/1985 Kabashima et al. ..... 503/201
4,803,193 2/1989 Kanda et al. ..... 503/209

FOREIGN PATENT DOCUMENTS 0434160 2/1943 Japan ..... 503/200
45-14039 5/1970 Japan ..... 503/200
58-38733 3/1983 Japan ..... 503/200
58-54085 3/1983 Japan ..... 503/200
58-104959 6/1983 Japan ..... 503/200
58-149388 9/1983 Japan ..... 503/200
59-115887 7/1984 Japan ..... 503/200
59-115888 7/1984 Japan ..... 503/200

*Primary Examiner*—Bruce H. Hess
*Attorney, Agent, or Firm*—Cushman, Darby & Cushman

[57] ABSTRACT

The present invention provides a heat-sensitive recording material excellent in image stability and heat-responsiveness which contains an aromatic isocyanate compound, an imino compound and at least one compound represented by the following formula (I):

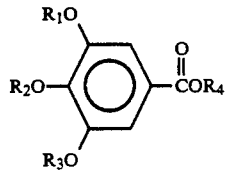

(I)

wherein $R_1$, $R_2$, $R_3$ and $R_4$ each represents an alkyl group.

4 Claims, No Drawings

HEAT-SENSITIVE RECORDING MATERIAL

BACKGROUND OF THE INVENTION

1. Field of the Invention

The present invention relates to a heat-sensitive recording material superior in image stability and good in heat responsiveness.

2. Related Art

Heat-sensitive recording materials generally comprise a support and, provided thereon, a heat-sensitive recording layer mainly composed of an electron donating colorless dye precursor and an electron accepting developer. Upon application of heat to the heat sensitive recording layer by a thermal head, hot pen, laser beam, and the like, the colorless dye precursor instantaneously reacts with the developer to form record images. These are disclosed in Japanese Patent Kokoku Nos. 43-4160 and 45-14039.

These heat-sensitive recording materials have such merits that record can be obtained by relatively simple devices and thus maintenance is easy and no noise is generated. Therefore, they are widely used in recorders for instruments, facsimile, printer, computer terminal equipment, labeling, ticket vending machines, and the like.

These heat-sensitive recording materials comprising electron donating colorless dye precursor and electron accepting developer have the excellent properties that they are good in appearance and touch and can provide high color density and various hues while they have the defects of inferior record stability, for example, theremally colored portion (recorded image portion) disappears due to plasticizers or additives contained in plastics upon contact with plastics such as polyvinyl chloride or readily disappears upon contact with foods or cosmetics or easily discolored upon exposure to sun light for a short time. Owing to these defects, their use is respected and solution of these defects have been strongly demanded.

As heat-sensitive recording materials which can form record images of good storage stability by reaction of two components upon application of heat, those which comprise an imino compound and an isocyanate compound as the two components are disclosed in Japanese Patent Kokai Nos. 58-38733, 58-54085, 58-104959, 58-149388, 59-115887 and 59-115888 and U.S. Pat. No. 4,521,793.

The heat-sensitive recording materials comprising isocyanate compound and imino compound being excellent in record stability are excellent in stability of image, but have the problem that they are insufficient in heat responsiveness and thus record images of sufficient density cannot be obtained by high-speed printing device.

For improvement of heat responsiveness, use of 2-benzyloxynaphalene or di(4-chlorobenzyl) oxalate has been proposed, but at present, higher heat responsiveness has been desired.

SUMMARY OF THE INVENTION

As a result of intensive research conducted by the inventors, it has been found that heat responsiveness can be improved with maintaining the excellent image stability by using lower alkyl esters of 3,4,5-trialkoxybenzoic acid and the present invention has been accomplished.

That is, heat-sensitive recording materials excellent in image stability and heat responsiveness can be obtained by using the compounds of the present invention.

DETAILED DESCRIPTION OF PREFERRED EMBODIMENTS

As mentioned above, according to the research conducted by the inventors in an attempt to obtain heat-sensitive recording materials excellent in image stability and heat responsiveness, heat-sensitive recording materials having excellent characteristics which have never been obtained using only conventional color formers have been obtained by containing at least one benzoic acid ester derivative represented by the following formula (I) in heat-sensitive recording materials comprising aromatic isocyanate compound and imino compound:

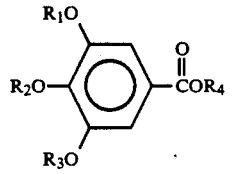

(I)

(wherein $R_1$, $R_2$, $R_3$ and $R_4$ may be identical or different and each represents an alkyl group).

As the alkyl group of $R_1$, $R_2$, $R_3$ and $R_4$, mention may be made of alkyl groups of 1-20 carbon atoms and these alkyl groups may have branch.

Typical examples of the compounds represented by the formula (I) include methyl 3,4,5-trimethoxybenzoate, ethyl 3,4,5-trimethoxybenzoate, propyl 3,4,5-trimethoxybenzoate, isoamyl 3,4,5-trimethoxybenzoate, octyl 3,4,5-trimethoxybenzoate, lauryl 3,4,5-trimethoxybenzoate, stearyl 3,4,5-trimethoxybenzoate, methyl 3,4,5-trimethoxybenzoate, and methyl 3,4,5-tripropyloxybenzoate.

Amount of the compound represented by the formula (I) is 30–400% by weight, preferably 50–300% by weight based on the aromatic isocyanate compound. If the amount is less than 30% by weight, good heat responsiveness cannot be obtained and if it is more than 400% by weight, dilution effect occurs and similarly, good heat responsiveness cannot be obtained.

The aromatic isocyanate compounds used in the present invention include colorless or light-colored aromatic isocyanate compounds or heterocyclic isocyanate compounds which are solid at room temperature and, for example, one or more of the following isocyanate compounds may be used.

2,6-Dichlorophenyl isocyanate, p-chlorophenyl isocyanate, 1,3-phenylene diisocyanate, 1,4-phenylene diisocyanate, 1,3-dimethylbenzene-4,6-diisocyanate, 1,4-dimethylbenzene-2,5-diisocyanate, 1-methoxybenzene-2,4-diisocyanate, 1-methoxybenzene-2,5-diisocyanate, 1-ethoxybenzene-2,4-diisocyanate, 2,5-dimethoxybenzene-1,4-diisocyanate, 2,5-diethoxybenzene-1,4-diisocyanate, 2,5-dibutoxybenzene-1,4-diisocyanate, azobenzene-4,4'-diisocyanate, diphenyl ether-4,4'-diisocyanate, naphthalene-1,4-diisocyanate, naphthalene-1,5-diisocyanate, naphthalene-2,6-diisocyanate, naphthalene-2,7-diisocyanate, 3,3'-dimethylbiphenyl-4,4'-diisocyanate, 3,3'-dimethoxybiphenyl-4,4'-diisocyanate, diphenylmethane-4,4'-diisocyanate, benzophenone-3,3'-diisocyanate, fluorene-2,7-diisocyanate, anthraquinone-2,6-diisocyanate, 9-ethylcarbazone-3,6-diisocyanate, pyrene-3,8-diisocyanate, naphthalene-1,3,7-triisocyanate, biphenyl-2,4,4'-triisocyanate, 4,4',4''-triisocyanate-2,5-dimethoxytriphyenylamine, p-dimethylaminophenyl isocyanate, and tris(4-phenylisocyanate) thiophosphate. If necessary, these isocyanate groups may be used in the form of so-called blocked isocyanates which are addition compound with phenols, lactams, oximes or the like, or in the form of diisocyanates, and furthermore, they may be used in the form of dimers of diisocyanates, for example, dimers of 1-methylbenzene-2,4-diisocyanate and in the form of isocyanurates which are trimers. However, when all of isocyanate groups are blocked, the effect of the present invention may not occur.

The imino compounds used in the present invention are compounds which have at least one >C=NH group in their molecule and are represented by the formula:

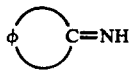

($\phi$ is an aromatic compound residue which can form a conjugated system with adjacent C=N) and are colorless or light-colored and solid at room temperature. Examples of these compound are shown below. These imino compounds may also be used in combination of two or more as required.

3-Iminoisoindoline-1-one, 3-imino-4,5,6,7-tetrachloroisoindoline-1-one, 3-imino-4,5,6,7-tetrabromoisoindoline-1-one, 3-imino-4,5,6,7-tetrafluoroisoindoline-1-one, 3-imino-5,6-dichloroisoindoline-1-one, 3-imino-4,5,7-trichloro-6-methoxy-isoindoline-1-one, 3-imino-6-methylmercapto-isoindoline-1-one, 3-imino-6-nitroisoindoline-1-one, 3-imino-isoindoline-1-spiro,dioxolan, 1-spiro-dioxolan, 1,1-dimethoxy-3-imino-isoindoline, 1,1-diethoxy-3-imino-4,5,6,7-tetrachloroisoindoline, 1-ethoxy-3-iminoisoindoline, 1,3-diiminoisoindoline, 1,3-diimino-4,5,6,7-tetrachloroindoline, 1,3-diimino-6-methoxyisoindoline, 1,3-diimino-6-cyanoisoindoline, 1,3-diimino-4,7-dithia-5,5,6,6-tetrahydroisoindoline, 7-amino-2,3-dimethyl-5-oxopyrrolo[3,4b] pyrazine, 7-amino-2,3-diphenyl-5-oxopyrrolo[3,4b 1-iminoaphthalic acid imide, 1-iminodiphenic acid imide, 1-iminonaphthalic acid imide, 1-iminodiphenic acid imide, 1-phenylimino-3-iminoisoindoline, 1-(3'-chlorophenylimino)-3-iminoisoindoline, 1-(2', 5'-dichlorophenylimino)-3-iminoisoindoline, 1-(2',4',5-trichlorophenylimino)-3-iminoisoindoline, 1-(2'-cyano-4'-nitrophenylimino)-3-iminoisoindoline, 1-(2'-chloro-5'-cyanophenylimino)-3-iminoisoindoline, 1-(2',6'-dichloro-4'-nitrophenylimino)-3-iminoisoindoline, 1-(2',5'-dimethoxyphenylimino-3-iminoisoindoline, 1-(2',5'-diethoxyphenylimino)-3-iminoisoindoline, 1-(2'-methyl-4'-nitrophenylimino)-3-iminoisoindoline, 1-(5'-chloro-2'-phenoxyphenylimino)-3-iminoisoindoline, 1-(4'-N,N-dimethylaminophenylimino)-3-iminoisoindoline, 1-(3'-N,N-dimethylamino-4'-methoxyphenylimino)-3-iminoisoindoline, 1-(2'-methoxy-5'-N-phenylcarbamoylphenyl-imino)-3-iminoisoindoline, 1-(2'-chloro-5'-trifluoromethylpheylimino)-3-iminoisoindoline, 1-(5'6'-dichlorobenzothiazolyl-2'-imino)-3-iminoisoindoline, 1-(6'-methylbenzothiazolyl-2'-imino)-3-iminoisoindoline, 1-(4'-phenylaminophenylimino)-3-iminoisoindoline, 1-(p-phenylazophenylimino)-3-iminoisoindoline, 1-(naphthyl-1'-imino)3-iminoisoindoline, 1-(anthraquinone-1'-imino)-3-iminoisoindoline, 1-(5'-chloroanthraquinone-1'-imino)-3-iminoisoindoline, 1-(n-ethylcarbazolyl-3'-imino)-3-iminoisoindoline, 1-(naphthoquinone-1'-imino)-3-iminoisoindoline, 1-(pyridyl-4'-imino)-3-iminoisoindoline, 1-(benzimidazolone-6'-imino)-3-iminosoindoline, 1-(1'-methylbenzimidazolone-6'-imino)-3-iminoisoindoline, 1-(7'-chlorobenzimidazolone-5'-imino)-3-iminoisoindoline, 1-(benzimidazolyl-2'-imino)-3-iminoisoindoline, 1-(benzimidazolyl-2'-imino)-3-4,5,6,7-tetrachloroisoindoline, 1-(2',4'-dinitrophenylhydrazone)-3-iminoisoindoline, 1-(indazolyl-3'-imino)-3-iminoisoindoline, 1-(indazolyl-3'-imino)-3-imino-4,5,6,7-tetrabromoiso indoline, 1-(indazolyl-3'-imino)-3-imino-4,5,6,7-tetrafluoroisoindoline, 1-(4',5'-dicyanoimidazolyl-2'-imino)-3-5,6-dimethyl-4,7-pyradiisoindoline, 1-(cyanobenzoylmethylene)-3-iminoisoindoline, 1-(cyanocarbonamidemethylene)-3-iminoisoindoline, 1-(cyanocarbomethoxymethylene)-3-iminoisoindoline, 1-(cyanocarboethoxymethylene)-3-iminoisoindoline, 1-(cyano-N-phenylcarbamoylmethylene)-3-iminoisoindoline, 1-[cyano-N-(3'-methylphenyl)carbamoylmethylene]-3-iminoisoindoline, 1-[cyano-N-(4'-chlorophenyl)carbamoylmethylene]-3-iminoisoindoline, 1-[cyano-N-(4'-methoxyphenyl)-carbamoylmethylene]-3-iminoisoindoline, 1-[cyano-N-(3'-chloro-4'-methylphenyl)-carbamoylmethylene]-3-iminoisoindoline, 1-(cyano-p-nitrophenylmethylene)-3-iminoisoindoline, 1-(dicyanomethylene)-3-iminoisoindoline, 1-(cyano-1',2',4'-triazolyl-(3')-carbamoylmethylene)-3-iminoisoindoline, 1-(cyanothiazoyl-(2'-carbamoylmethylene)-3-iminoisoindoline, 1-(cyanobenzimidazolyl-2')-carbamoylmethylene-3-iminoisoindoline, 1-(cyanobenzo-thiazolyl-(2')-carbamoylmethylene)-3-iminoisoindoline, 1-[(cyanobenzimidazolyl-2')-methylene]-3-iminoisoindoline, 1-[(cyanobenzimidazolyl-2')methylene]-3-imino-4,5,6,7-tetrachloroisoindoline, 1-[cyanobenzimidazolyl-2')-methylene]-3-imino-5-methoxyisoindoline, 1-[(cyanobenzimidazolyl-2')methylene]-3-imino-6-chloroisoindoline, 1-[(1'-phenyl-3'-methyl-5-oxo)-pyrazolidene-4+]-3-iminoisoindoline, 1-[(cyanobenzimidazolyl-2')-methylene]-3-imino-4,7-dithiatetrahydroisoindoline, 1-[(cyanobenzimidazolyl-2')-methylene]-3-imino-5,6-dimethyl-4,7-pyradiisoindoline, 1-[(1'-methyl-3'-n-butyl)-barbituric acid-5']-3-iminoisoindoline, 3-imino-1-sulfo-benzoic acid imide, 3-imino-1-sulfo-6-chlorobenzoic acid imide, 3-imino-1-sulfo-5,6-dichlorobenzoic acid imide, 3-imino-1-sulfo-4,5,6,7-tetrachlorobenzoic acid imide, 3-imino-1-sulfo-4,5,6,7-tetrabromobenzoic acid imide, 3-imino-1-sulfo-4,5,6,7-tetrafluorobenzoic acid imide, 3-imino-1-sulfo-6-nitrobenzoic acid imide, 3-imino-1-sulfo-6-methoxybenzoic acid imide, 3-imino-1-sulfo-4,5,7-trichloro-6-methylmercaptobenzoic acid imide, 3-imino-1-sulfonaphthoic acid imide, 3-imino-1-sulfo-5-bromonaphthoic acid imide, and 3-imino-2-methyl-4,5,6,7-tetrachloroisoindoline-1-one.

As aforesaid, the heat-sensitive recording material of the present invention comprises a support on which is provided a heat-sensitive recording layer which forms color upon heating. As the support, paper is mainly used, but there may also be used various nonwoven fabrics, synthetic resin films, laminate papers, synthetic papers, metallic foils or composite sheets comprising combination thereof depending on objects. The heat-sensitive recording layer may be of single layer structure or multi-layer structure. In the case of the multi-layer structure, intermediate layer may be provided between respective layers. Besides, a protective layer may be provided on the recording layer. This recording layer can be formed by mixing respective aqueous dispersions obtained by pulverizing respective color forming components with binder or the like, coating the resulting mixture on the support and drying the coat. In this case, for example, the recording layer may be of multi-layer structure, each layer of which contains each color forming component.

The heat-sensitive recording material of this invention may contain a heat-meltable substance material in order to improve its sensitivity. The heat-meltable substance preferably has a melting point of 60°–180° C., especially 80°–140° C. As examples of the heat-meltable substance, mention may be made of benzyl p-benzyloxy-benzoate, stearic acid amide, palmitic acid amide, N-methylolstearic acid amide, β-naphthylbenzyl ether, N-stearylurea, N,N-distearylurea, phenyl β-naphthoate, phenyl 1-hydroxy-2-naphthoate, β-napthol(p-methylbenzyl) ether, 1,4-dimethoxynaphthalene, 1-methoxy-4-benzyloxy-naphthalene, N-stearoylurea, 4-benzylbiphenyl, 1,2-di(m-methylphenyxy)ethane, 1-phenoxy-2-(4-chlorophenoxy)ethane, 1,4-butanediol-phenyl ether, and dimethyl terephthalate.

The above heat-meltable materials may be used singly or in admixture and for obtaining sufficient responsiveness, it is used preferably in an amount of 10–300% by weight, more preferably 2–250% by weight based on the aromatic isocyanate compound.

The heat-sensitive recording material of the present invention may further contain aniline derivatives having at least one amino group as disclosed in the inventors' international application No.PCT/JP81/00300 and this is more effective for inhibition of fogging of background.

These compounds include, for example, methyl p-aminobenzoate, ethyl p-aminobenzoate, n-propyl p-aminobenzoate, iso-propyl p-aminobenzoate, butyl p-aminobenzoate, dodecyl p-aminobenzoate, benzyl p-aminobenzoate, o-aminobenzophenone, m-aminoacetophenone, p-aminoacetophenone, m-aminobenzamide, o-aminobenzamide, p-aminobenzamide, p-amino-N-methylbenzamide, 3-amino-4-methylbenzamide, 3-amino-4-methoxybenzamide, 3-amino-4chlorobenzamide, p-(N-phenylcarbamoyl)aniline, p-[N-(4-chlorophenyl)carboamoyl]aniline, p-[N-(4-aminophenyl)-carbamoyl]aniline, 2-methoxy-5-(N-phenylcarbamoyl)aniline, 2-methoxy-5- N-(2'-methyl-3'-chlorophenyl)carbamoyl aniline, 2-methoxy-5- N-(2'-chlorophenyl)carbamoyl aniline, 5-acetylamino-2-methoxyaniline, 4-acetyl-aminoaniline, 4-(N-methyl-N-acetylamino)aniline, 2,5-diethoxy-4-(N-benzoylamino)aniline, 2,5-dimethoxy-4-(N-benzoylamino)aniline, 2-methoxy-4-(N-benzoylamino)-5-methylaniline, 4-sulfamoylaniline, 3-sulfamoyl-anilene, 2-(N-ethyl-N-phenylaminosulfonyl)aniline, 4-dimethylaminosulfonylaniline, 4-diethylaminosulfonyl-anilene, sulfathiazole, 4-aminodiphenylsulfone, 2-chloro-5-N-phenylsulfamoylaniline, 2-methoxy-5-N,N-diethylsulfamoylaniline, 2,5-dimethoxy-4-N-phenyl-sulfamoylaniline, 2-methoxy-5-benzylsulfonylaniline, 2-phenoxysulfonylaniline, 2-(2'-chlorophenoxy)sulfonylanilene, 3-anilinosulfonyl-4-methylaniline, bis[4-(m-aminophenyoxy)phenyl] sulfone, bis[4-(p-aminophenoxy)phenyl]sulfone, bis[3-methyl-4-(p-aminophenoxy)phenyl]sulfone, 3,3'-dimethoxy-4,4'-diaminobiphenyl, 3,3'-dimethyl-4,4'-diaminobiphenyl, 2,2'-dichloro-4,4'-diamino-5,5'-dimethoxybiphenyl, 2,2',5,5'-tetrachloro-4,4'-diaminobiphenyl, o-tolidine-sulfone, 2,4'-diaminobiphenyl, 2,2'-diaminobiphenyl, 4,4'-diaminobiphenyl, 2,2'-dichloro-4,4'-diaminobiphenyl, 3,3'-dichloro-4,4'-diaminobiphenyl, 2,2'-dimethyl-4,4'-diaminobiphenyl, 4,4'-thiodianiline, 2,2'-dithiodianiline, 4,4'-dithiodianiline, 4,4'-diaminodiphenyl ether, 3,3'-diaminodiphenyl ether, 3,4'-diaminodiphenyl ether, 4,4'-diaminodiphenylmethane, 3,4'-diaminodiphenylmethane, bis(3-amino-4-chlorophenyl)sulfone, bis(3,4-diaminophenyl)sulfone, bis(4-aminophenyl)sulfone, bis(3-aminophenyl)sulfone, 3,4'-diaminodiphenyl-sulfone, 3,3'-diaminodiphenylmethane, 4,4'-ethylenedianiline, 4,4'-diamino-2,2'dimethyldibenzyl, 4,4'-diamino-3,3'-dichlorodiphenylmethane, 3'-diaminobenzophenone, 4,4'-diaminobenzophenone, benzene, 1,3-bis(3-aminophenoxy)benzene, 9,9-bis(4-aminophenyl)fluorene, 2,2-bis(4-aminophenoxyphenyl)-propane, 4,4'-bis(4-aminophenoxy)diphenyl, 3,3',4,4'-tetraaminodiphenyl ether, 3,3',4,4'-tetraaminodiphenyl-sulfone, and 3,3',4,4'-tetraaminobenzophenone.

As binders used in the heat-sensitive recording materials of the present invention, mention may be made of, for example, water-soluble binders such as starches, hydroxyethyl cellulose, methylethyl cellulose, carboxymethyl cellulose, gelatin, casein, polyvinyl alcohol, modified polyvinyl alcohol, styrene-maleic anhydride copolymer, and ethylene-maleic anhydride copolymer and latex type water-insoluble binders such as styrene-butadiene copolymer, acrylonitrile-butadiene copolymer, and methyl acrylate-butadiene copolymer.

The heat-sensitive recording layer may further contain pigments such as diatomaceous earth, talc, kaoline, calcined kaolin, calcium carbonate, magnesium carbonate, titanium oxide, zinc oxide, silicon oxide, aluminum hydroxide, and urea-formalin resin, and besides, metallic salts of higher fatty acids such as zinc stearate and calcium stearate and waxes such as paraffin, paraffin oxide, polyethylene, polyethylene oxide, stearic acid amide, and castor wax for inhibition of wear of head and inhibition of sticking, dispersants such as sodium dioctylsulfosuccinate, ultraviolet absorbers of benzophenone type and benzotriazole type, surfactants and fluorescent dyes.

The present invention will be explained in more detail by the following examples.

EXAMPLE 1

15 g of 1,3-diimino-4,5,6,7-tetrachloroiso-indoline was ground in a ball mill for 24 hours together with 60 g of 1% aqueous polyvinyl alcohol solution and separately, 10 g of 4,4',4''-triisocyanate-2,5-dimethoxytriphenylamine was ground in a ball mill for 24 hours together with 40 g of 1% aqueous polyvinyl alcohol solution to obtain dispersions. Furthermore, similarly, 0.4 g of 2-methoxy-N,N-diethylsulfamoylaniline was ground together with 20 g of 1% aqueous polyvinyl alcohol solution and besides, similarly, 25 g of methyl 3,4,5-trimethoxybenzoate was ground together with 25 g of 1% aqueous polyvinyl alcohol solution to obtain dispersions, respectively. These four dispersions were mixed and then, to the mixture were added 125 g of 40% aqueous dispersion of calcium carbonate, 50 g of 30% aqueous dispersion of zinc stearate, 135 g of 10% aqueous polyvinyl alcohol solution and 90 g of water and then the mixture was sufficiently stirred to obtain a coating liquid. This coating liquid was coated on a base paper of 50 g/m$^2$ in basis weight at a coating amount of 5.2 g/m$^2$ in solid content, then dried and supercalendered to obtain a heat-sensitive recording material.

COMPARATIVE EXAMPLE 1

A heat-sensitive recording material was obtained in the same manner as in Example 1 except that 2-benzyloxynaphthalene was used in place of methyl 3,4,5-trimethoxybenzoate.

COMPARATIVE EXAMPLE 2

A heat-sensitive recording material was obtained in the same manner as in Example 1 except that di(4-chlorobenzyl) oxalate was used in place of methyl 3,4,5-trimethoxybenzoate.

COMPARATIVE EXAMPLE 3

A heat-sensitive recording material was obtained in the same manner as in Example 1 except that methyl 3,4,5-trimethoxybenzoate was not used and coating amount of coating liquid was 4.2 g/m$^2$ in solid content.

Test 1 (color density=heat responsiveness=)

The heat-sensitive recording materials obtained in Example 1 and Comparative Examples 1-3 were printed by heat sensitive facsimile printing tester under conditions of applied pulse of 1.0 msec and 1.4 msec and applied voltage of 22.0 volts. Density of the resulting color images were measured by densitometer Macbeth RD918 and the results are shown in Table 1.

Test 2 (Plasticizer resistance=image stability=)

Each of the heat-sensitive recording materials obtained in Example 1 and Comparative Examples 1-3 was put on a polyvinyl chloride sheet. This was stored in atmosphere of 40° C. for 24 hours under application of a load of 300 g/m$^2$. Thereafter, density of color formed portion was measured as in the test 1 and image retention rate is shown in Table 1.

$$\text{Image retention rate} = \frac{\text{Image density after the test}}{\text{Image density before the test}} \times 100(\%)$$

TABLE 1

| | Test 1 (heat responsiveness) | | Test 2 (image stability) |
|---|---|---|---|
| | 1.0 msec | 1.4 msec | Image retention rate |
| Example 1 | 0.76 | 1.02 | 100% |
| Comparative Example 1 | 0.68 | 0.96 | 100% |
| Comparative Example 2 | 0.45 | 0.83 | 100% |
| Comparative Example 3 | 0.32 | 0.61 | 100% |

What is claimed is:

1. A heat.sensitive recording material which contains an aromatic isocyanate compound, an imino compound and at least one compound represented by the following formula (I):

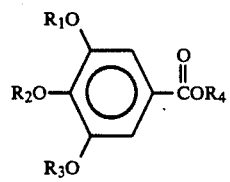

(I)

wherein $R_1$, $R_2$, $R_3$ and $R_4$ each represents an alkyl group.

2. A heat-sensitive recording material according to claim 1, which contains the compound represented by the formula (I) in an amount of 30–400% by weight based on the aromatic isocyanate compound.

3. A heat-sensitive recording material according to claim 1 which additionally contains a heat-meltable substance having a melting point of 60° -180° C.

4. A heat-sensitive recording material according to claim 1, wherein the compound represented by the formula (I) is methyl, ethyl, propyl, butyl, octyl or lauryl ester of 3,4,5-trimethoxybenzoic acid.

* * * * *